United States Patent [19]

Neumeister

[11] 4,070,939

[45] Jan. 31, 1978

[54] EDGE CONTROL FOR CALENDER COVERING INDUSTRIAL BELTING

[75] Inventor: Alvin W. Neumeister, Tallmadge, Ohio

[73] Assignee: The Goodyear Tire & Rubber Company, Akron, Ohio

[21] Appl. No.: 730,041

[22] Filed: Oct. 6, 1976

[51] Int. Cl.[2] ..... B26D 5/34; B32B 31/18

[52] U.S. Cl. ..... 83/368; 83/364; 83/72; 156/353

[58] Field of Search ..... 83/368, 364, 72, 365, 83/360; 156/353

[56] References Cited

U.S. PATENT DOCUMENTS

| | | | |
|---|---|---|---|
| 2,910,122 | 10/1959 | Anderson et al. | 83/368 |
| 3,008,864 | 11/1961 | Macklem et al. | 83/368 X |
| 3,073,197 | 1/1963 | Gown | 83/368 |
| 3,276,492 | 10/1966 | Kervefors | 83/364 |

*Primary Examiner*—Donald R. Schran

*Attorney, Agent, or Firm*—F. W. Brunner; R. S. Washburn

[57] ABSTRACT

An apparatus for squaring or trimming the edges of the elastomeric (uncured) cover of an industrial belt. An edge sensor is disposed to track each of the edges of a bare or uncovered carcass foward of the calender nip in which the cover is applied. Rotating trim blades for trimming excess gum from the respective edges of the covered belt are moved laterally proportionally to the algebraic sum of the deviations of the edges of the carcass from their respective ideal lines. Thus, an adequate but not excessive amount of the cover gum is provided to cover the respective edges of the carcass of the belt. The respective edge sensors are hydraulically connected with the trim blades for synchronized movement so as to maintain the described thickness of cover gum outwardly from the edges of the carcass. The foregoing abstract is not to be taken as limiting the invention of this application, and in order to understand the full nature and extent of the technical disclosure of this application, reference must be made to the accompanying drawing and the following detailed description.

7 Claims, 3 Drawing Figures

EDGE CONTROL FOR CALENDER COVERING INDUSTRIAL BELTING

The present invention relates to the manufacture of industrial belting, particularly to applying to the body or carcass of industrial belting a covering layer of suitable gum stock. Still more particularly the invention relates to a hydromechanical belt edge trimming device for use in an industrial belt calender.

In the manufacture of industrial belting a carcass comprising longitudinal strength members such as cord or wire cables is covered by an uncured suitable compound of natural and/or synthetic rubbers, commonly referred to as gum, and which gum provides the outer cover desired for the belt both to provide the surface characteristics desired in the belt and to protect the carcass in service. The belting is then subjected to a curing process. Industrial belting will be understood to include belts for material conveying, belts for power transmission service, which belts find useful employment in a variety of industry.

The gum applied to form the cover of the belt is normally applied to the carcass in a calender having at least two parallel cooperating rolls forming a nip through which the carcass travels and in which nip the gum is applied. In order that the edges of the carcass be suitably covered, the gum which is applied to the width of the carcass is permitted to extend beyond the lateral edges of the carcass to supply the gum required to cover the lateral edges. This gum extending outwardly of the lateral edges of the carcass is subsequently trimmed to provide a desirable configuration of the belt edge itself.

Because the respective edges of the belt carcass tend to vary slightly and independently of the theoretical lines to which the respective edges of the carcass should conform, and because such edges are hidden by the application of the gum cover to the carcass, it has heretofore been difficult and even impossible to trim the edges of the belt without having either an excess of gum overlying the lateral edge of the belt or, on the other hand, exposing cords of the carcass.

A principal object, therefore, of the present invention is to provide for trimming the edges of the gum cover applied to the carcass, such that the gum covering of the carcass edge is neither excessive in thickness nor insufficient to maintain a protective cover upon the carcass edge.

Briefly, the foregoing object and others which will become apparent presently are accomplished in accordance with the invention in an industrial belting calender for applying a gum cover to an industrial belting carcass, the improvement comprising, a pair of sensing means disposed to sense lateral deviations of the respective edges of said carcass entering said calender, an adjustably spaced apart pair of gum edge trimming blades disposed to trim edges of said belting exiting from said calender, and means for moving said pair of blades laterally of said belting by an amount equal to one-half the algebraic sum of the lateral deviations of the edges of said carcass sensed by said sensors.

To acquaint persons skilled in the arts most closely related to the present invention, certain preferred embodiments thereof illustrating a best mode now contemplated for putting the invention into practice are described herein by and with reference to the annexed drawings forming a part of the specification. The embodiments shown and described herein are illustrative and as will become apparent to those skilled in these arts can be modified in numerous ways within the spirit and scope of the invention defined in the claims hereof.

Figure 1:
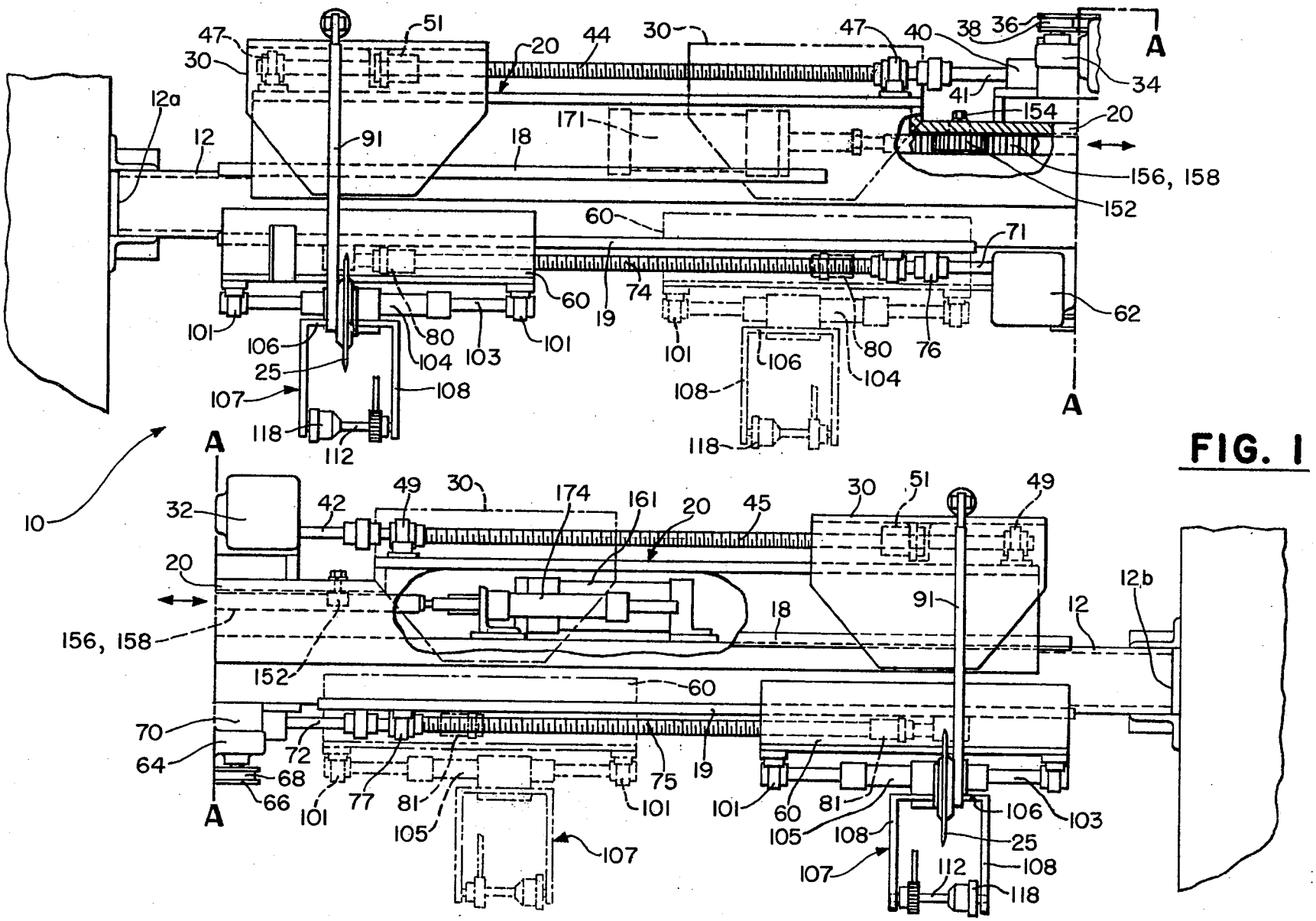
FIG. 1 is a plan view of a belt edge trimming device according to the invention.
Figure 2:
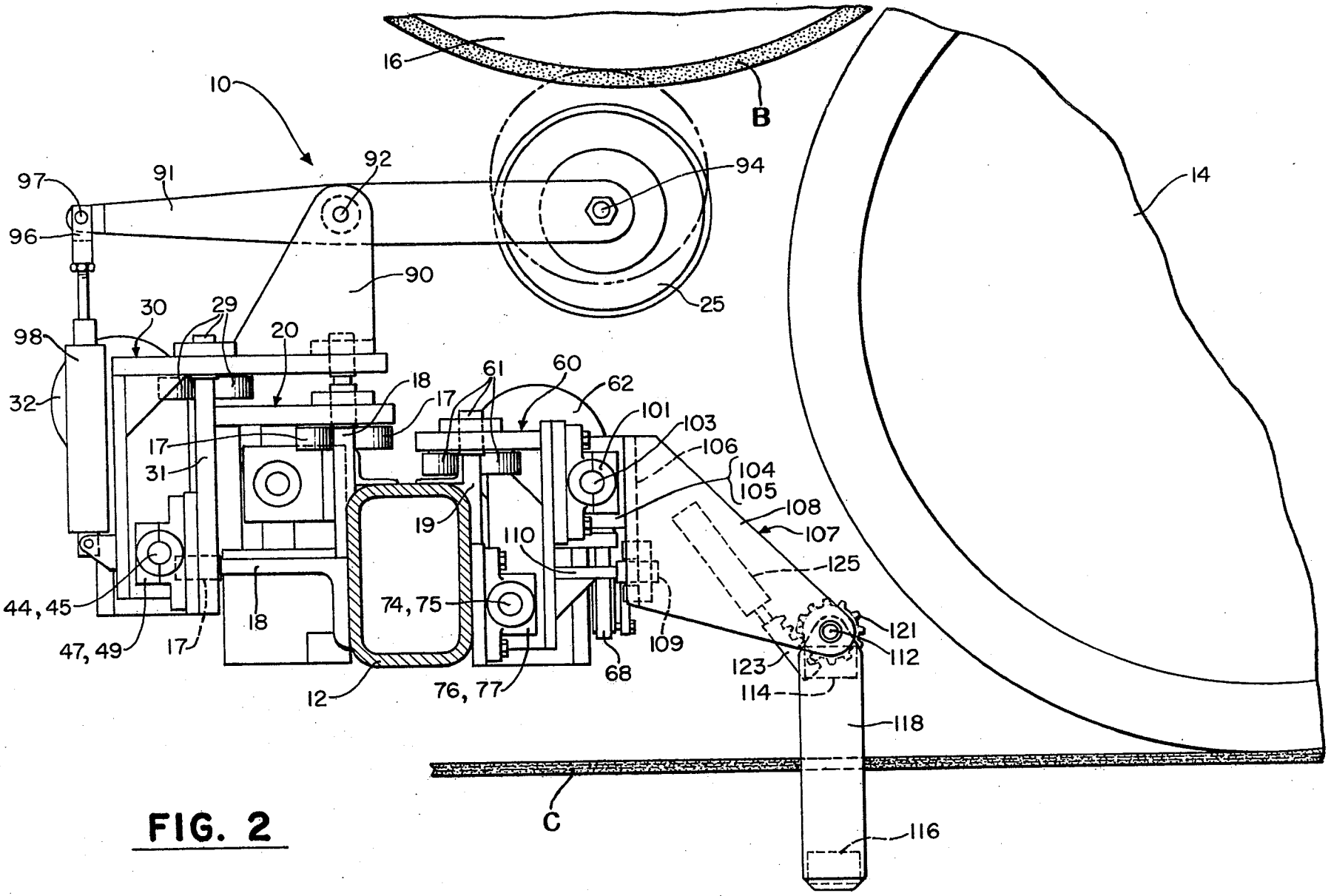
FIG. 2 is an end view of the device of FIG. 1.

With reference to FIGS. 1 and 2, the hydromechanical belt edge trimming device 10 in accordance with the invention comprises a main support beam 12 adapted to be fixed at its respectively opposite ends 12*a*,12*b* relative to and to extend parallel to the rolls 14,16 of a belt covering calender (not shown). The beam 12 is provided with suitable guide rails 18,19 which extend parallel to the calender rolls.

A main carriage 20 is mounted on the main beam 12 for movement longitudinally thereof, being guided in its longitudinal movement by a plurality of guide wheels 17 which engage the guide rails 18 of the main beam.

The main carriage is provided with a hydromechanical drive means to move the carriage longitudinally of the beam to dispose an adjustably spaced apart pair of trimming blades 25 with respect to the belt to be trimmed. The details and operation of the hydromechanical drive means will be described more fully later herein. A first allochiral pair of blade carriages 30, each carrying a belt edge trimming blade 25, are disposed respectively on the right and left portions of the main carriage 20 and are correspondingly of right and left-hand construction. Each of the carriages 30 has a plurality of guide rollers 29 engaging the rails 31 for movement relative to and longitudinally of the main carriage 20.

To provide for adjustably fixing the respective blade carriages 30 and the trimming blades mounted thereon relatively of the main carriage, a first drive means is provided by a motor 32 which drives a right angle gear box 34 having a pulley 36 which is connected by an endless belt 38 to a second pulley driving the in-shaft of a bevel gear box 40 having output shafts 41,42 extending coaxially oppositely therefrom. Each output shaft is connected, respectively, by a conventional coupling to a screw 44,45 mounted in bearings 47,49 affixed to the main carriage 20. Each of the carriages 30 has mounted nonrotatably thereon a fixed nut 51 meshed, respectively, with the screws 44,45 in such a manner that rotation of the screws causes the carriages 30 to move longitudinally of the main carriage 20. The respective screws are threaded with equal and opposite leads and it will thus be seen that the respective carriages 30 will be moved equally and oppositely on the main carriage 20 by the motor. The lateral distance parallel to the beam 12 between the blades 25 is thus adjustably fixed and thereby the width of the belt B from edge to edge is determined.

A second allochiral pair of carriages 60 having carcass edge sensors mounted thereon are mounted for equal and opposite movement on and relative to the main beam 12, there being a plurality of guide rolls 61 in each of the carriages which engage the respectively associated guide rails 19 of the main beam.

In order to adjust the respective positions of the second pair of carriages 60 and thereby the belt edge sensor means carried by each, a second drive means comprising also a motor 62, a right angle gear box 64 having a pulley 66 connected by an endless belt 68 to a pulley driving a right angle bevel gear box 70 which also has its two output shafts 71,72 aligned coaxially with one another. Each output shaft is connected, respectively, by a coupling to a screw 74,75 which is mounted rotatably in bearings 76,77 affixed to the main beam. Each of the sensor carriages 60 is provided with a nut 80,81 non-rotatably fixed thereto whereby in response to the rotation of the respective screw, the sensor carriage is moved longitudinally of the beam, the two carriages 60 thus being moved equally and oppositely of each other. The two carriages 60 are thus prepositioned a suitable distance apart. Each of the blade carriages 30 has a bracket 90 standing upward from the upper surface thereof to support pivotally a blade arm 91 which swings about the pivot pin 92 to move a rotatable trimming blade 25 toward and away from the cooperating roll 16 of the calender. The blade rotates freely about its axle 94 to trim the respective lateral edge of the belt. Each blade arm is extended oppositely from the pivot pin to connect with the clevis 96 by a pivot pin 97. The clevis is attached to the rod of an air cylinder 98 which is pivotally mounted on the carriage 30 and can be remotely operated so as to swing the blade 25 to engage or to disengage the calender roll and the belt therearound.

The second pair of carriages 60, namely, the sensor carriages, each support a pair of clamps 101 in each pair of which is fixed the piston rod 103 of a cylinder 104,105 extending parallel to the beam 12. Each cylinder 104,105 is fixed to the base 106 of a bracket 107 having a pair of arms 108. A guide roll 109 in each base rolls on a rail 110 fixed on the respective carriage 60. Each cylinder and bracket are movable, parallel to the beam 12, relatively of the respective carriage 60 in response to oil pressures in the respective cylinders.

A shaft 112 is mounted on and between the arms 108 of each bracket. An edge sensor comprising a receiver 114 and a sender 116 are fixed in spaced opposition on an arm 118 fixed on each shaft 112. In its operating position each arm 118 extends about normal to the plane of the carcass C outwardly of and close to the carcass edge. The receiver 114 is thereby located above and the sender 116 below the carcass edge tracked by the sensor.

For operating convenience, the shaft 112 is provided with a pinion 121 which engages a rack 123 which is moved relative to the shaft by an air cylinder 125 to rotate the pinion and the sensor arm 118. The arrangement provides for swinging the sensor arm upwardly about the shaft to facilitate inserting or removing a carcass or belt from the calender.

Figure 3:
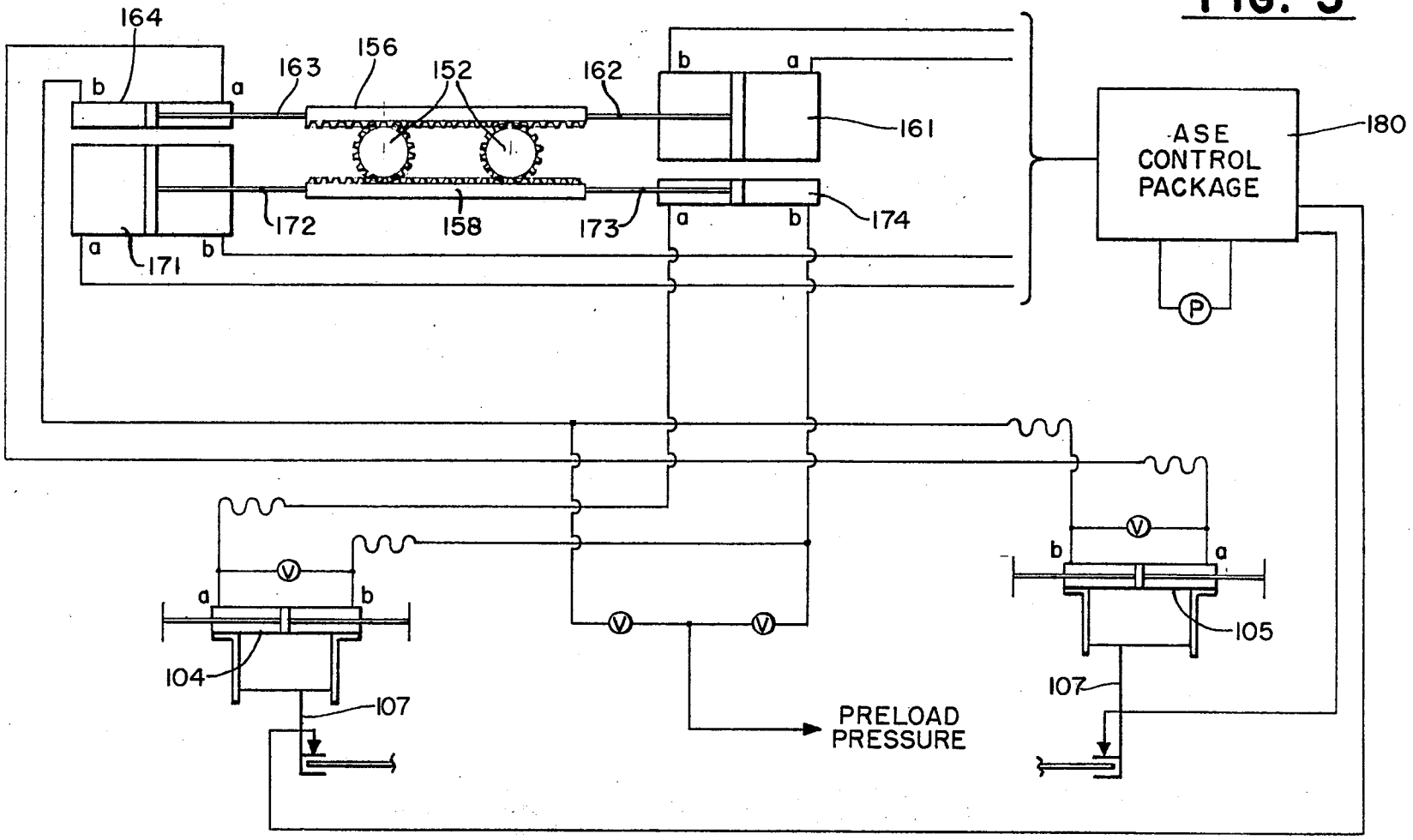
FIG. 3 is a schematic representation of the hydromechanical drive of the device of FIG. 1.

With reference to FIG. 3, the hydromechanical drive means previously referred to is provided in the present embodiment by two pairs of hydraulic cylinders affixed to the main beam 12, a pair of pinions 152, which are rotatably mounted on the pinion studs 154 fixed on the main carriage 20 and a parallel pair of racks 156,158 which drivingly engage the respective pinions and are themselves moved in response to the respectively associated hydraulic cylinders. A first master cylinder 161 has its piston rod 162 connected with the rack 156 which is in turn connected with the piston rod 163 of a smaller cylinder 164 also fixed on the beam 12 in such a manner that the movement of the piston of the cylinder 161 is communicated directly to the rack 156 and to the piston of the cylinder 164. The second master cylinder 171 has its piston rod 172 connected directly to the other rack 158 which is in turn connected to the piston rod 173 of a smaller cylinder 174 again in such a manner that movement of the piston in the master cylinder 171 is communicated directly to the second rack 158 and to the piston of the smaller cylinder 174.

The respective ends *a,b* of each of the larger cylinders 161,171 are connected to a signal processor 180 which includes hydraulic servo-valves therein by which the flow of oil to the respective larger cylinders is controlled.

The signal processor 180 is a commercially available product supplied by Alexeff-Snyder Enterprises of Cleveland, Ohio. The belt edge sensors, which are also obtained from Alexeff-Snyder Enterprises, each utilize a standard photocell receiver 114 and a lamp or light beam sender 116 and detect the position of the associated edge of the moving carcass photoelectrically and transmit their respective outputs to the signal processor 180 in which an electrohydraulic servo-valve is actuated to control the associated master cylinder.

To maintain a fixed relation between each edge trimming blade 25 and the respectively associated edge sensor, each cylinder 104,105 is connected directly at each of its ends *a,b* by an oil line to the respectively associated end *a,b* of the respective cylinders 164 and 174. The movement of the cylinder 104 is hydraulically locked to the piston rod 173 so that each moves equally in direction and distance. The same relation is made between the cylinder 105 and the piston rod 163. The arrangement provides for precise relation of the positions of the respective sensors to the trim blades 25 without mechanical linkages and allows for readily altering the relative location of the sensors in the direction of travel of the carcass with respect to the trim blades.

For example, the carriages 60 can be easily mounted on a second beam similar to but spaced from the main beam 12 to suit particular installation or operational requirements, without any change in the hydraulic connections of the respective cylinders 104,105 and 174,164.

As may be observed in FIG. 3, the hydraulic system is provided with means for introducing oil to a predetermined preload pressure.

The arrangement described has a particular advantage of controlling the locations of the respective trim blades such that the carcass is at least approximately centered between the trimmed edges of the belt cover, thus making the quantity of gum covering the respective lateral edges of the belt approximately equal in thickness despite deviations in the locations of the respective edges of the carcass as the carcass moves through the calender nip.

The operation of the device can best be described by considering the effect of the displacement of a single carcass edge from its ideal path. A deviation or displacement of the one edge causes the output of the photocell receiver 114 to change, emitting a signal which is communicated to the signal processor 180 wherein the signal is amplified and processed to shift a servo-valve so as to increase the pressure and volume of oil delivered to the appropriate end of the master cylinder, e.g. to 171, which tends to move the main carriage 20 and the blades 25 in the direction required to follow the deviation. Displacement of the piston and rod 172 in response to the increased oil pressure causes the associated rack 158 to move the piston of the cylinder 174 in the same direction. This movement displaces oil in the associated end, e.g. *a* of the cylinder 174 which displaced oil flows to the end *a* of the sensor edge following cylinder 104, thereby shifting the belt edge sensor in the direction of the edge displacement. This movement continues until the sensor is relocated with respect to the edge such as to restore the signal to the processor to its null condition.

If the opposed lateral edge of the carcass is not at the same time displaced, the movement of the rack 158 tends to rotate the pinions 152 relative to the other rack 156 thereby displacing the carriage 20, to which the pinions are rotatably fixed, proportionately and in particular exactly one-half of the actual displacement of the sensor. This in turn causes the trim blades 25 to be displaced proportionally and in particular one-half of the distance through which the carcass has temporarily deviated.

If the other edge is displaced, the second edge sensor provides a signal to the processor 180 which in response actuates flow of oil to the associated master cylinder, e.g. 161, to displace its piston rod 162, the associated rack 156, and the piston of the cylinder 164 by a like amount. Displacement of the piston then feeds oil to the end of the slave cylinder 105 such as to restore the location of the sensor to null the signal in the processor 180.

It will be appreciated that the corrective movements are, in normal operation, continuous. Further, it is to be understood that the movements of the respective racks create a simultaneous movement of the carriage 20, on which the trim blades are carried, through a displacement which is half of the algebraic sum of the displacements of the respective sensors. The hydromechanical drive means is thus responsive to the edge sensors by way of the signal processor and is operable to move each sensor an amount proportional to the edge deviation sensed by the sensing means and simultaneously to move the two trim blades 25 a predetermined fraction of that amount, this fraction being in the embodiment disclosed exactly one-half of the deviation sensed by the individual sensor and one-half the algebraic sum, giving account to the direction of deviations, detected in the two edges of the carcass.

While certain representative embodiments and details have been shown for the purpose of illustrating the invention, it will be apparent to those skilled in the art that various changes and modifications may be made therein without departing from the spirit or scope of the invention.

What is claimed is:

1. In an industrial belting calender having a plurality of rolls and spaced apart side frames, a hydromechanical belt edge trimming device comprising a main support beam fixed on and extending between said side frames and extending parallel to one of said rolls, a main carriage mounted on the main beam for movement longitudinally thereof, a first allochiral pair of carriages supported on and movable longitudinally of the beam, first drive means fixed on the beam and connected to move the first pair of carriages toward and away from each other, a second allochiral pair of carriages supported on and movable longitudinally of the main carriage, second drive means fixed on the main carriage and connected to move the second pair of carriages toward and away from each other, a trimming blade supported respectively on each of the second pair of carriages, a sensor supported on and movable parallel to the beam relatively of each of the first pair of carriages for sensing respectively the edges of a carcass of an industrial belt, each sensor being capable of providing a signal proportional to the amount and direction of a deviation in location of said carcass edge, and hydromechanical drive means responsive to said signals to move each of said sensors relative to the respectively associated carriage and to move said main carriage a distance equal to one-half the algebraic sum of the deviations of said carcass edge.

2. In an industrial belting calender having a sensor for monitoring lateral deviations of a belt carcass entering said calender and a gum edge trimming blade for trimming an edge of belting exiting from said calender, the improvement comprising, signal detection means for receiving and processing signals from the sensor and including a plurality of fluid flow control valves, and hydromechanical drive means responsive to said detection means and operable to move said sensor an amount proportional to the edge deviation sensed by the sensor and, concurrently, to move said trimming blade a predetermined fraction of said amount.

3. In an industrial belting calender as claimed in claim 2, the hydromechanical means comprising a master cylinder and a first slave cylinder each having pistons, a gear rack connected for longitudinal movement proportional to the movement of the pistons relative to the respective cylinders, a pinion mounted rotatably on an axis fixed relative to the lateral position of said trimming blade and drivably meshed with said rack, and a second slave cylinder connected hydraulically with the first slave cylinder and movable in response to movement of the piston therein to move said sensor.

4. In an industrial belting calender for applying a gum cover to an industrial belting carcass, the improvement comprising a pair of sensing means disposed to sense lateral deviations of the respective edges of said carcass entering said calender, an adjustably spaced apart pair of gum edge trimming blades disposed to trim edges of said belting exiting from said calender, and means for moving said pair of blades laterally of said belting by an amount equal to one-half the algebraic sum of the lateral deviations of the edges of said carcass sensed by said sensors.

5. A device as claimed in claim 1, said trimming blade comprising a rotatable blade having a circular edge adapted to shear gum excess from said belting, said blade being mounted on the respectively associated carriage for movement toward and away from one of said calender rolls in a plane perpendicular to the axis of said roll.

6. A device as claimed in claim 1, said first drive means comprising a nut fixed to each of said first pair of carriages, a pair of coaxially arranged screws threaded in the respective said nuts, and motor means constructed and arranged to rotate said screws.

7. A device as claimed in claim 1, said second drive means comprising a nut fixed to each of said second pair of carriages, a pair of coaxially arranged screws threaded in the respective said nuts, and motor means constructed and arranged to rotate said screws.

* * * * *